US006558188B1

(12) United States Patent
Mantey et al.

(10) Patent No.: US 6,558,188 B1
(45) Date of Patent: May 6, 2003

(54) IMPEDANCE CONTROLLED ELECTRICAL CONNECTOR ASSEMBLY

(75) Inventors: Paul J. Mantey, Fort Collins, CO (US); Wallace K Johnson, American Fork, UT (US)

(73) Assignee: Hewlett Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/599,122

(22) Filed: Jun. 22, 2000

(51) Int. Cl.[7] ..... H01R 12/24
(52) U.S. Cl. ..... 439/499
(58) Field of Search ..... 439/499, 497, 439/494, 502, 492, 362, 404; 174/117 F, 117 FF

(56) References Cited

U.S. PATENT DOCUMENTS 3,212,046 A * 10/1965 Abel ..... 439/502
3,864,011 A * 2/1975 Huber ..... 439/494
4,012,093 A * 3/1977 Crane ..... 439/67
4,658,090 A * 4/1987 Coon ..... 174/119 R
5,161,986 A * 11/1992 Gulbranson et al. ..... 439/92

* cited by examiner

*Primary Examiner*—Javaid Nasri

(57) ABSTRACT

An electrical connector assembly has a flexible circuit with a first end portion, a second end portion, a first surface, and a second surface. A plurality of conductors extend between the first end portion and the second end portion within the circuit. A first connector assembly is attached to the circuit first end portion. The first connector assembly has a first connector electrically connected to at least one of the plurality of conductors, a first plate substantially encompassing the first connector and located adjacent the circuit first surface, and a second plate located adjacent the circuit second surface and opposite the first plate. The first plate and the second plate are mechanically coupled.

31 Claims, 6 Drawing Sheets

IMPEDANCE CONTROLLED ELECTRICAL CONNECTOR ASSEMBLY

TECHNICAL FIELD OF THE INVENTION

The present invention relates to electrical connectors and, more particularly, to an electrical connector having a precise, preselected impedance and blind mate capabilities.

BACKGROUND OF THE INVENTION

Electrical connectors serve to electrically connect various electronic components within an electronic device. For example, an electronic device may have modular electronic components that transfer data between each other and, thus, need to be electrically connected. One example of such an electronic device is a computer. Electrical connectors are often used within computers to electrically connect components, such as peripheral component interconnect (PCI) circuits or "boards" to a processing component, such as a motherboard. More specifically, the electrical connectors are used to transfer data signals between the PCI boards and the motherboard.

As greater processing capabilities are developed for computers and other electronic devices, more data signals are required to be transferred at higher frequencies. In addition to greater processing capabilities, many electronic devices are being designed to occupy minimal space, which requires that the electronic components be compacted within the minimal space of the electronic devices.

Conventional electrical connectors do not have the capabilities to meet the criteria for operating within the above-described electronic devices. The increase in the quantity and frequency of data signals being transferred by the electrical connectors requires that the electrical connectors have more conductors to carry the data signals. The increased frequency further requires that the electrical connectors have appropriate impedance, shielding, and physical layout characteristics for proper high frequency data transfer. Inappropriate impedance characteristics cause high frequency data signals to attenuate significantly between the electronic components. The high frequency data signals typically generate and are susceptible to electromagnetic interference (EMI), thus, the electrical connectors have to be shielded.

In addition to the above-described operating criteria, electrical connectors have to meet other physical criteria for use within the small confines of electronic devices. For example, many of the electronic components are removable, which means that the electrical connectors have to be able to be readily disconnected from and connected to the electronic components. In addition, the electrical connectors should be as short as possible to optimize data transfer, which makes the process of physically connecting and disconnecting the connectors very difficult. For example, a user may not be able to see an electrical connector and may not properly align the electrical connector to its proper electronic component.

Electrical connections between components within an electronic device must also be able to withstand shock, vibration and other forces. For example, some of the electronic components mounted within the electronic device are mounted to a chassis via a shock absorbing mechanism. These electronic components move relative to each other and relative to the chassis when they are subject to shock and vibration. Accordingly, a rigid electrical connector between these components will likely fail prematurely.

Therefore, a need exists for an electrical connector that has a plurality of conductors, is impedance controlled, and is able to be used within the small confines of an electronic device so as to overcome the problems associated with conventional electrical connectors.

SUMMARY OF THE INVENTION

The present invention is directed toward a flexible connector for transferring high frequency data signals. The connector may comprise a flexible circuit having a first end portion, a second end portion, a first surface, and a second surface. The flexible circuit may have a plurality of conductors extending between the first end portion and the second end portion. A first connector assembly may be attached to the circuit first end portion and a second connector assembly may be attached to the circuit second end portion. The first connector assembly may comprise a connector electrically connected to the plurality of conductors wherein a first plate substantially encompasses the connector and is located adjacent the circuit first surface. A second plate may be located adjacent the circuit second surface and aligned with the first plate wherein the first plate and the second plate are mechanically coupled.

The flexible circuit may comprise a conductive layer having plurality of conductors. The conductive layer may be sandwiched between a first and a second ground plane. The intrinsic impedance of the conductors relative to the ground planes is set to a preselected value by varying the physical layout of the circuit. For example, the intrinsic impedance is dependent on, among other variables, the distance between the conductors and the ground planes, the widths of the conductors, and the permativity of materials used within the circuit.

DETAILED DESCRIPTION OF THE INVENTION

Figure 1:
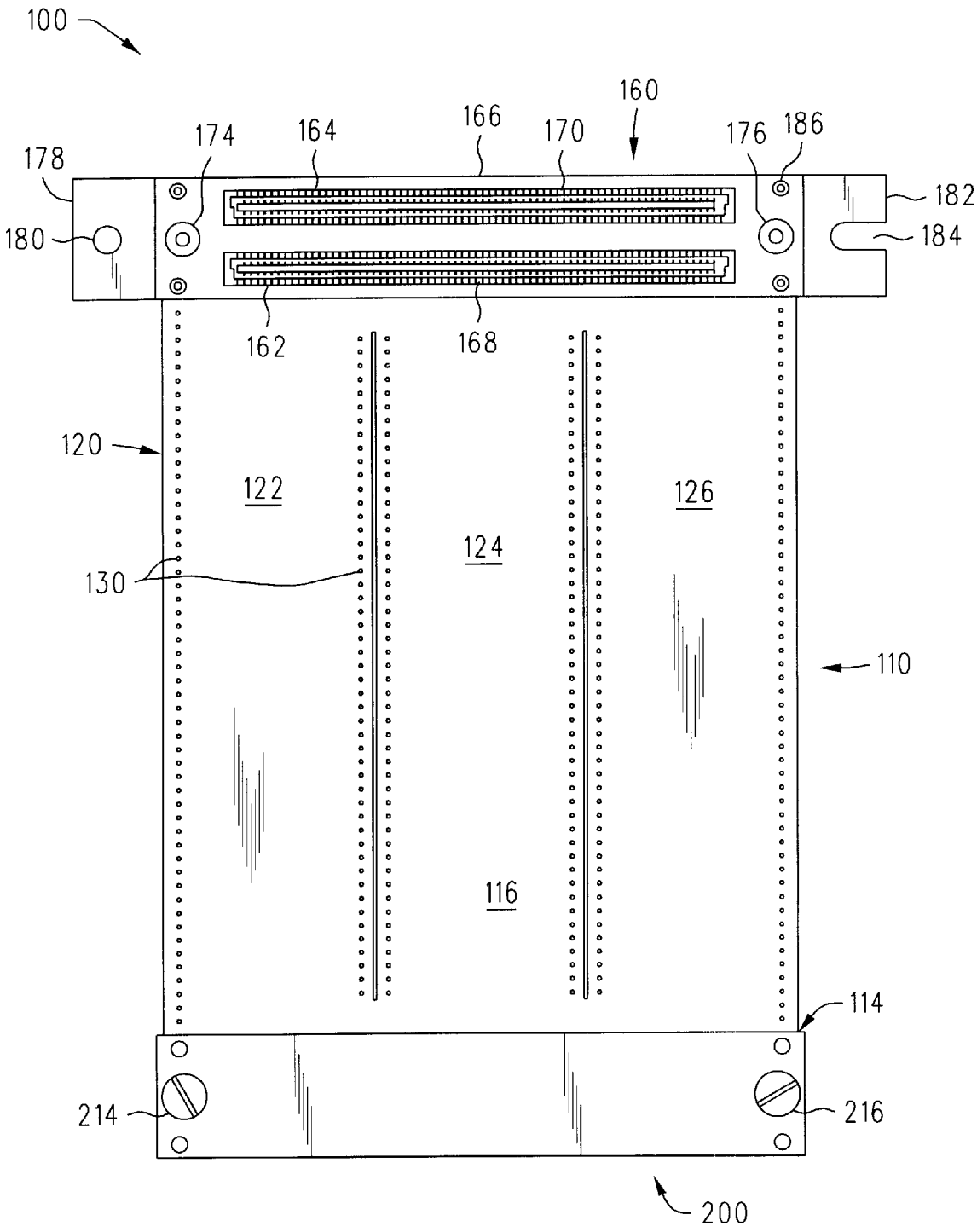
FIG. 1 is a plan view of an embodiment of an electrical connector.

FIGS. 1 through 6, in general illustrate an electrical connector assembly 100, sometimes referred to herein simply as an electrical connector. The electrical connector 100 may comprises a flexible circuit 110 having a first end portion 112, a second end portion 114, a first surface 116, and a second surface 117. The flexible circuit 110 may have a plurality of conductors 157 extending between the first end portion 112 and the second end portion 114. The connector assembly may further comprise a first connector assembly 160 attached to the circuit first end portion 112. The first connector assembly 160 may comprise a first connector 162 electrically connected to at least one of the plurality of conductors 157; a first plate 166, sometimes referred to as a first support member, substantially encompassing the first connector 162 and located adjacent the circuit first surface 116; a second plate 190, sometimes referred to as a second support member, located adjacent the circuit second surface and opposite the first plate 166; the first plate 166 and the second plate 190 being mechanically coupled.

FIGS. 1 through 6 also, in general illustrate an electronic device 300. The electronic device may comprise: a first component 310 having a first connector 334 associated therewith, a second component 312 having a second connector 344 associated therewith, and an electrical connector assembly 100. The electrical conductor assembly 100 may comprise a flexible circuit 110 having a first end portion 112, a second end portion 114, a first surface 116, and a second surface 117. The flexible circuit 110 may have a plurality of conductors 157 extending between the first end portion 112 and the second end portion 114. The connector assembly may further comprise a first connector assembly 160 attached to the circuit first end portion 112 and a second connector assembly 200 attached to the circuit second end portion 114.

The first connector assembly 160 may comprise a first connector 162 electrically connected to at least one of the plurality of conductors 157; a first plate 166, sometimes referred to as a first support member, substantially encompassing the first connector 162 and located adjacent the circuit first surface 116; a second plate 190, sometimes referred to as a second support member, located adjacent the circuit second surface and opposite the first plate 166; the first plate 166 and the second plate 190 being mechanically coupled.

The second connector assembly 200 may comprise: a second connector 202, sometimes referred to as the third connector, electrically connected to at least one of the plurality of conductors 157; a third plate 206, sometimes referred to as the first support member, substantially encompassing the second connector 202 and located adjacent the circuit second surface 117; and a fourth plate 222, sometimes referred to as the second support member, located adjacent the circuit first surface 116 and opposite the third plate 206. The third plate 206 and the fourth plate 222 may be mechanically coupled. The circuit first connector 162 is electrically connected to the first component first connector 334 and the circuit second connector 202 may be electrically connected to the second component second connector 344.

A plan view of the electrical connector 100 is illustrated in FIG. 1. The electrical connector 100 may have a flexible circuit 110 having a first end portion 112 and a second end portion 114. A plurality of conductors, not shown in FIG. 1, may extend between the first end portion 112 and the second end portion 114. The electrical connector 100 may have a first surface 116 and a second surface, not shown in FIG. 1, opposite the first surface 116.

The flexible circuit 110 may have a plurality of circuit sections 120. The non-limiting embodiment of FIG. 1 has three circuit sections 120 a first section 122, a second section 124, and a third section 126. The flexible circuit 110 may have several layers, which reduce its flexibility. By separating the flexible circuit 110 into the circuit sections 120, the flexibility of the flexible circuit 110 is improved. Each of the circuit sections 120 may be sealed with stitching 130 that serves to reduce electromagnetic interference from being emitted from or received by the flexible circuit 110, as is described below.

Figure 2:
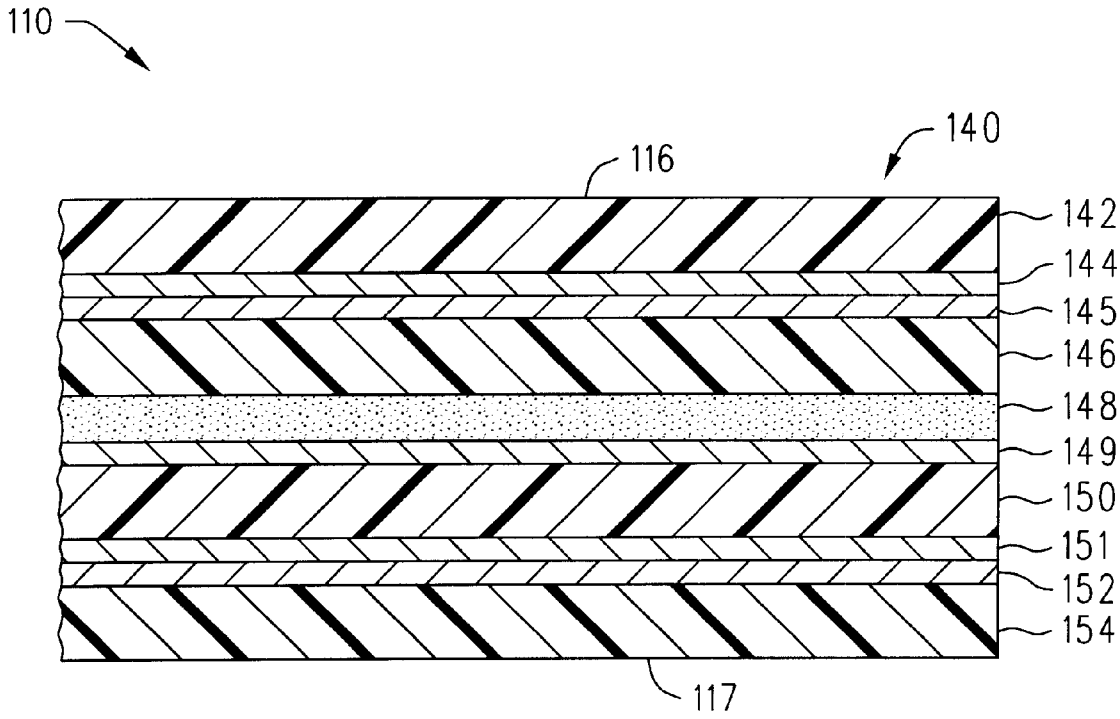
FIG. 2 is a side cut away schematic illustration of a flexible circuit used in the electrical connector of FIG. 1.

A side cut away schematic illustration of the flexible circuit 110 is illustrated in FIG. 2. The flexible circuit 110 has the first surface 116 and a second surface 117 with a plurality of layers 140 sandwiched therebetween. The layers 140 are referred to as the first through the tenth layers. The first layer 142 may be an insulation layer and may have a thickness of approximately 0.0016 inches. The first layer 142 may, as an example, be made of a polyimide film, such as the product sold by the E. I. du Pont de Nemours and Company under the trade name KAPTON. The second layer 144 may be a plated layer and may have a thickness of approximately 0.0010 inches. The second layer 144 may serve as a surface to electrically connect conductors to the flexible circuit 110. It should be noted that the second layer 144 may only be present in areas of the flexible circuit 110 where the conductors are located.

The third layer 145 may be an electrically conductive sheet having a thickness of approximately 0.0009 inches and may have a tolerance of ten percent. The third layer 145 may, as an example, be a sheet of one-half ounce copper. As is described below, the third layer 145 serves to attenuate EMI as well to provide a return path for signals propagating on the sixth layer 149. Adjacent the third layer 145 is a fourth layer 146. The fourth layer 146 is less conductive than the third layer 145 and may, as an example, be made of Kapton. The thickness of the fourth layer 146 is one of the factors that determines the intrinsic impedance of the flexible circuit 110 as is described below. The fourth layer 146 may, as an example, have a thickness of approximately 0.0024 inches and may have a tolerance of ten percent. Adjacent the fourth layer 146 is a fifth layer 148. The fifth layer 148 is a conventional adhesive and may have a thickness of approximately 0.0020 inches. The properties of the adhesive may have minimal affects on the intrinsic impedance of the flexible circuit 110.

A sixth layer 149 may be adjacent and adhered to the fifth layer 148. The sixth layer 149 has a plurality of conductors formed therein and is described in greater detail below with reference to FIG. 3. A seventh layer 150 may be located adjacent the sixth layer 149 and may be a dielectric substantially similar to the fourth layer 146. An eighth layer 151 is located adjacent the seventh layer 150 and may be a conductive layer that is substantially similar to the third layer 145. A ninth layer 152 may be located adjacent the eighth layer 151 and may be substantially similar to the second layer 144 and may not extend the length of the flexible circuit 110. The ninth layer 152 may serve to electrically connect conductors located adjacent the second surface 117 of the flexible circuit 110. A tenth layer 154 may be located adjacent the ninth layer 152 and may be substantially similar to the first layer 142. When the layers 140 are assembled as described above, the first surface 116 and the second surface 117 may be separated by a distance of approximately 0.0147 inches. It should be noted that the sizes of the layers 140 of FIG. 2 have been greatly enlarged for illustration purposes. It should also be noted that the thicknesses of the layers 140 are not drawn to scale.

The flexible circuit 110 has been described above as being fabricated from several individual layers 140. Some of the layers 140, however, may be combined. For example, the third layer 145 and the fourth layer 146 may be a single sheet or layer of an insulator or dielectric having a conductor plated thereto. The third layer 145 may be a conductive layer that is plated to the fourth layer 146, which is an insulating layer. Likewise, the sixth layer 149, the seventh layer 150, and the eighth layer 151 may be a single layer. The seventh layer 150 may be an insulating layer, and the sixth layer 149 and the eighth layer 151 may be conductive layers plated onto the seventh layer 150. The adhesive layer 148 may serve to adhere the above-described two layers together.

A plurality of vias may extend between the layers 140 and may serve to electrically connect specific layers to external conductors. For example, vias may extend from the exterior of the flexible circuit 110 to the conductors in the sixth layer 149 or the conductive planes of the third layer 145 and the eighth layer 151. The vias may be plated as is known in the art to provide appropriate electrical conductivity.

The stitching 130 of FIG. 1 may serve to seal first layer 142 to the tenth layer 154, which in turn compresses the third layer 145 to the eighth layer 151. This compression of the third layer 145 to the eighth layer 151 causes them to electrically contact, which improves the electromagnetic shielding of the flexible circuit 110 and, thus, reduces electromagnetic interference. The stitching 130 of FIG. 1 also serves to keep contaminants from entering the flexible circuit 110.

Figure 3:
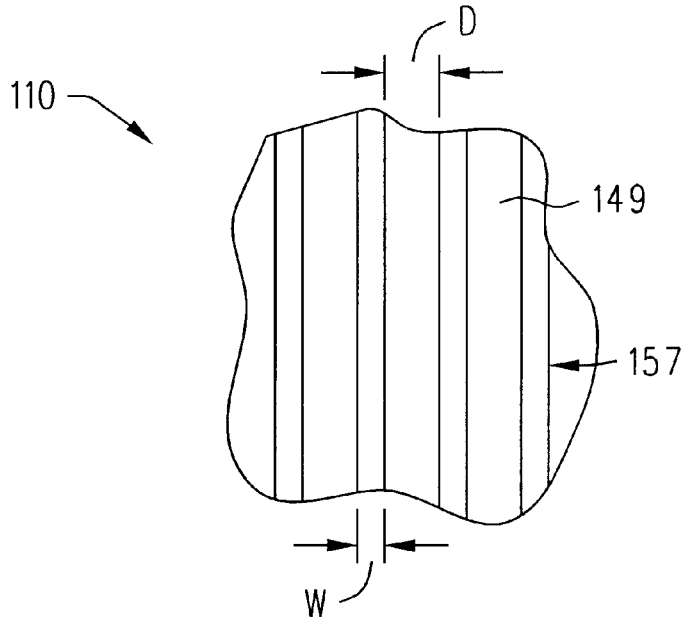
FIG. 3 is a top, cut away schematic illustration of the conductor layout within the electrical connector of FIG. 1.

Referring to FIG. 3, which is a plan view of the sixth layer 149 of the flexible circuit 110, a plurality of substantially parallel conductors 157 may be formed within the sixth layer 149. It should be noted that the conductors 157 shown in FIG. 3 have been greatly enlarged for illustration purposes. The conductors 157 may extend between the first end portion 112, FIG. 1, and the second end portion 114, FIG. 1, of the flexible circuit 110. The conductors 157 may, as a non-limiting example, be conventional one-half ounce copper. Each of the conductors 157 may have a width W and may be separated by a distance D. The width W may, as an example, be approximately 0.004 inches and the distance D may, as an example, be between approximately 0.0120 and 0.0140 inches and more preferably approximately 0.0135 inches.

Per the above description of the non-limiting embodiment of the flexible circuit 110, a layer of conductors 157 extends between the first end portion 112 and the second end portion 114. The conductors 157 are located between the third layer 145 and the eighth layer 151, which may operate at the same electrical potential, e.g., ground. Accordingly, the conductors 157 function as transmission lines, wherein the intrinsic impedance of the conductors 157 relative to the third layer 145 and the eighth layer 151 is preselected by selecting physical criteria of the flexible circuit 110. For example, the distance D, the width W, and the permativity of the layers 140, FIG. 1, and the thicknesses of the fourth layer 146, the fifth layer 148, and the seventh layer 150, are some of the variables that determine the intrinsic impedance. The intrinsic impedance of the conductors 157 relative to the third layer 145 and the eighth layer 151 may, as an example, be approximately fifty ohms.

In some applications of the electrical connector 100, high frequency data, e.g., binary data, may be transmitted between the first end portion 112 and the second end portion 114. For example, the data may be source synchronous signals. In such applications, it is critical that all of the conductors 157 or groups of the conductors 157 may have the same lengths. For example, the lengths of the conductors 157 may be within 0.01 inches of each other. Maintaining constant lengths of the conductors 157 improves the signal timing, which in turn allows for higher frequency signals to be transmitted via the flexible circuit 110.

Referring again to FIG. 1, each end portion 112 and 114 of the flexible circuit 110 may have an electrical connector assembly electrically and mechanically connected thereto. The first end portion 112 may have a first connector assembly 160 attached thereto. The first connector assembly 160 may have a first connector 162 and a second connector 164 electrically and mechanically connected to the flexible circuit 110. Conventional electric conductors, not shown, in the first connector 162 and the second connector 164 may be electrically connected to the conductors 157, FIG. 3, or other conductors, not shown, located within the flexible circuit 110. It should be noted that both the first connector 162 and the second connector 164 are shown extending perpendicularly from the first surface 116 of the flexible circuit 110. In other embodiments of the electrical connector 100, the first connector 162 and the second connector 164 may extend from other angles relative to the flexible circuit 110. For example, they may extend parallel to the flexible circuit 110.

The first connector assembly 160 may have a first support member 166 located adjacent the first end portion 112 of the flexible circuit 110. A first cutout 168 and a second cutout 170 may be formed in the first support member 166. The first cutout 168 may substantially encompass the first connector 162 and the second cutout 170 may substantially encompass the second connector 164. The first support member 166 may have a first mounting portion 178 having a hole 180 formed therein and a second mounting portion 182 having a slot 184 formed therein. The first support member 166 may have a plurality of rivets 186 placed therethrough, which serve to attach the first support member 166 to a second support member described below.

Figure 4A:
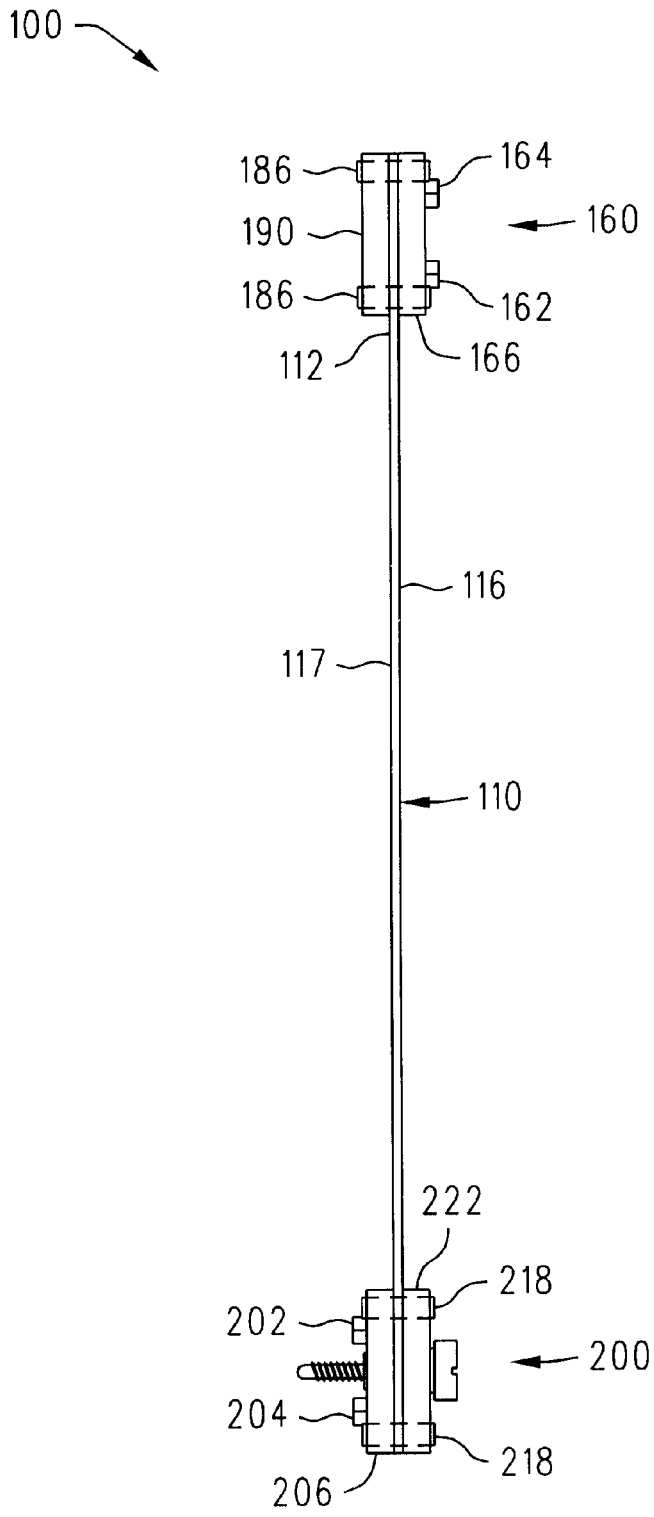
FIG. 4A is a side view of the electrical connector of FIG. 1.
Figure 4B:
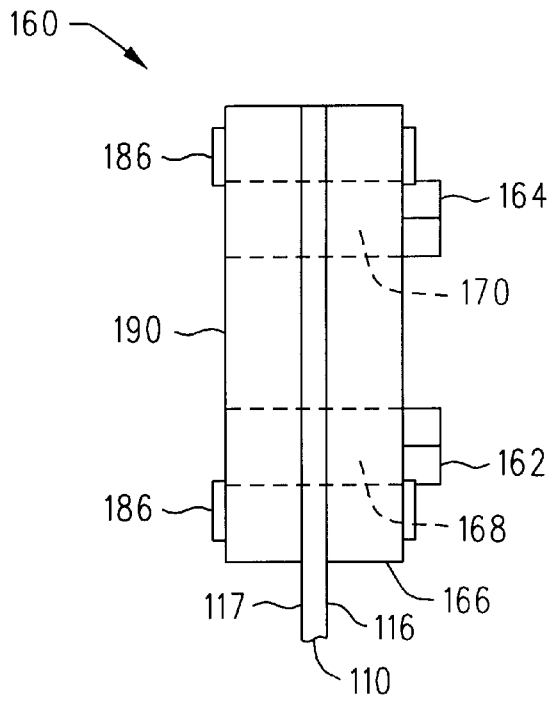
FIG. 4B is a partial cut away view of the first connector assembly of FIG. 4A.

Reference is made to FIGS. 4A and 4B. FIG. 4A is a side view of the electrical connector 100 of FIG. 1 and FIG. 4B is a partial cut away view of the first connector assembly 160. As shown in FIGS. 4A and 4B, the first connector assembly 160 may also have a second support member 190. The second support member 190 may be located adjacent the second side 117 of the flexible circuit 110. The rivets 186 serve to couple the first support member 166 to the second support member 190. More specifically, the first end portion 112 of the flexible circuit 110 may be sandwiched between the first support member 166 and the second support member 190. This sandwiching causes the portions of the flexible circuit 110 connected to the first connector 162 and the second connector 164 to abut the second support member 190. These portions of the flexible circuit 110 are, thus, prevented from flexing due to stresses caused by use of the first connector 162 and the second connector 164. It should be noted that the first mounting portion 178, FIG. 1, and the second mounting portion 182, FIG. 1, may be parts of the second support member 190 rather than the first support member 166.

Having described the first connector assembly 160, a second connector assembly 200 will now be described. The second connector assembly 200 is substantially similar to the first connector assembly 160.

Figure 5:
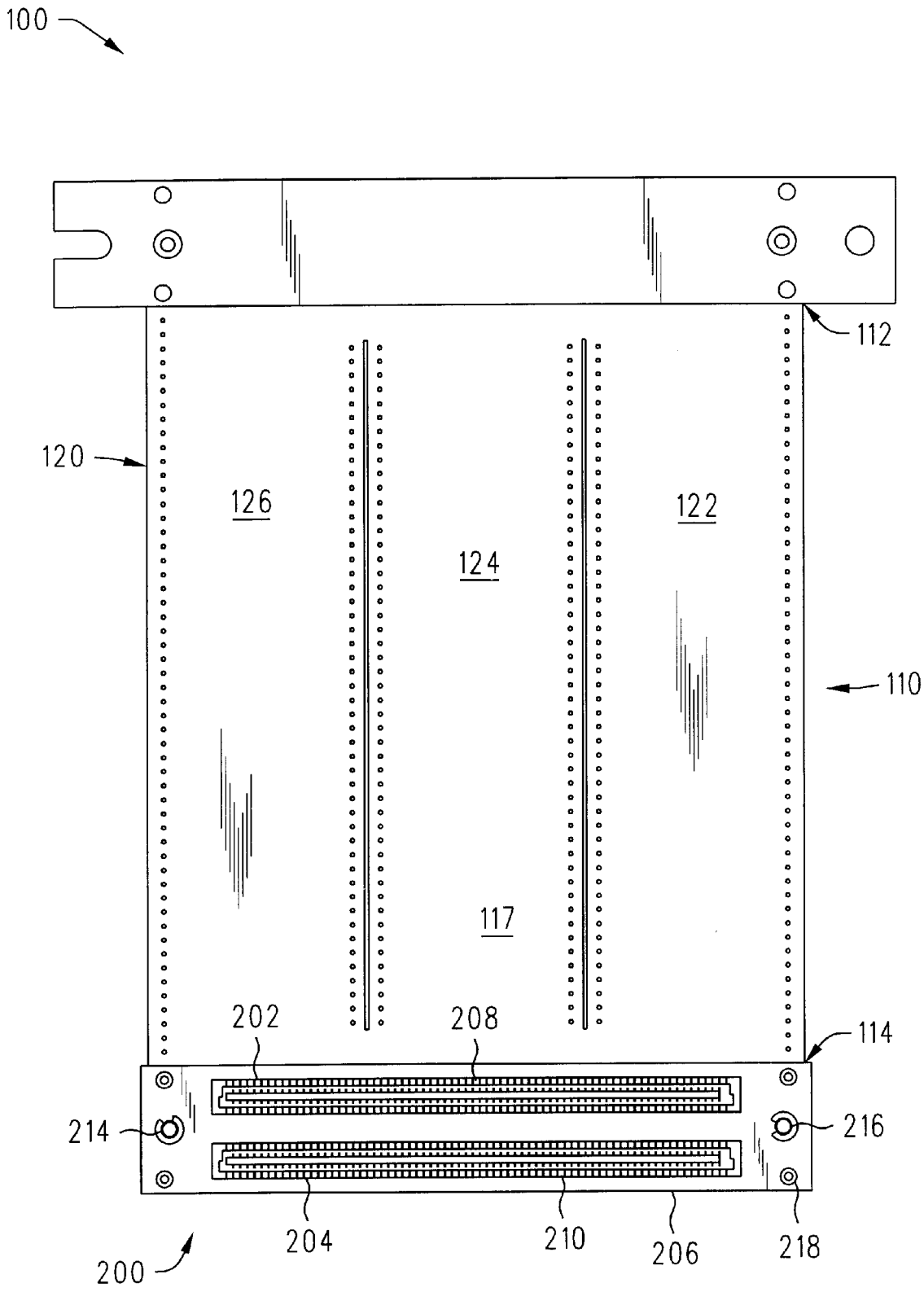
FIG. 5 is a plan view of the opposite side of the electrical connector of FIG. 1.

Referring to FIG. 5, which is a plan view of the second side 117 of the flexible circuit 110, the second connector assembly 200 may be attached to the second end portion 114 of the flexible circuit 110. The second connector assembly 200 may have a third connector 202 and a fourth connector 204 electrically and mechanically connected to the second end portion 114 of the flexible circuit 110. More specifically, the third connector 202 and the fourth connector 204 may have electrical conductors that are electrically and mechanically connected to the conductors 157, FIG. 3, or other conductors extending through the flexible circuit 110.

The second connector assembly 200 may also have a first support member 206 having a first cutout 208 and a second cutout 210 formed therein. The first cutout 208 may substantially encompass the third connector 202 and the second cutout 210 may substantially encompass the fourth connector 204. The first support member 206 may also have a first screw 214, a second screw 216, and a plurality of rivets 218 extending therethrough. The first screw 214 and the second screw 216 may, as examples, be captive screws.

Figure 4C:
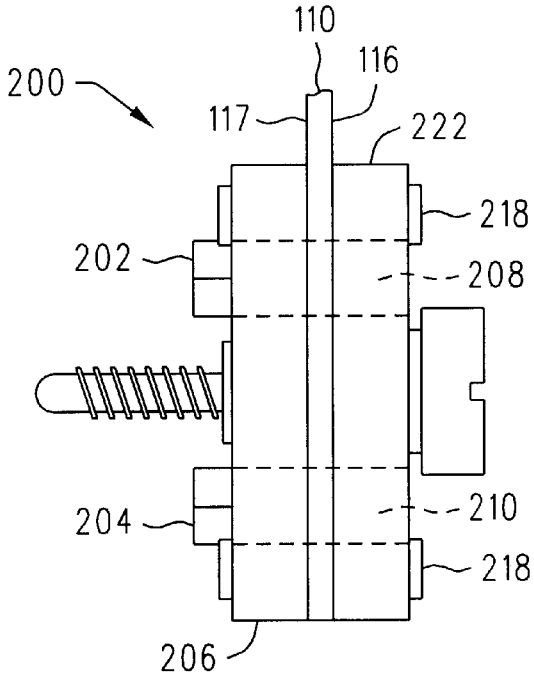
FIG. 4C is a partial cut away view of the second connector assembly of FIG. 4A.

Reference is made to FIGS. 4A and 4C. FIG. 4C is a partial cut away view of the second connector assembly 200. As shown, the second connector assembly 200 may also have a second support member 222 that abuts the first surface 116 of the flexible circuit 110. Accordingly, the second end portion 114 of the flexible circuit 110 is sandwiched between the first support member 206 and the second support member 222. Accordingly, the sandwiching prevents the portions of the flexible circuit 110 corresponding to the third connector 202 and the fourth connector 204 abut the second support member 222 from flexing. The rivets 218 serve to couple the first support member 206 to the second support member 222.

Having described the components of the electrical connector 100, its operation will now be described.

Referring to FIGS. 1 and 5, the electrical connector 100 serves to provide electric signal paths between the first connector 162 and the second connector 164 at the first end portion 112 of the flexible circuit 110 and the third connector 202 and the fourth connector 204 at the second end portion 114 of the flexible circuit 110. More specifically, the electrical connector 100 serves to electrically connect components, not shown, connected to the first connector assembly 160 and the second connector assembly 200 of the flexible circuit 110. The flexible circuit 110 allows the components to move relative to each other or be at various fixed positions relative to each other during operation.

The electrical connector 100 may, as a non-limiting example, have approximately two hundred conductors 157, FIG. 3, extending between the first end portion 112 and the second end portion 114 of the flexible circuit 110. As described above, the conductors 157 are sandwiched between two ground planes. The intrinsic impedance of the signal conductors relative to the ground conductors is established to a precise value, e.g., fifty ohms, by the above-described physical characteristics of the electrical connector 100. The precise value of the intrinsic impedance provides for improved transmission line characteristics between the first end portion 112 and the second end portion 114. The improved transmission line characteristics allow high frequency signals, e.g., 120–145 MHz, to be transmitted via the electrical connector 100 with minimal attenuation.

Many of the conductors transmit signals that are processed simultaneously, such as data or addressing signals. As described above, the signals may be source synchronous signals. By maintaining the conductors 157, FIG. 3, or groups of the conductors 157 at the same lengths, e.g., within 0.01 inches of each other, all the signals arrive at the connectors and, thus, an electronic component at the same time. This timing improves the frequency at which signals may be transmitted via the electrical connector 100 because skews associated with signal timing are reduced.

Having described the electrical connector 100 and its operation, it will now be described being used within an electronic device 300, FIG. 6.

Figure 6:
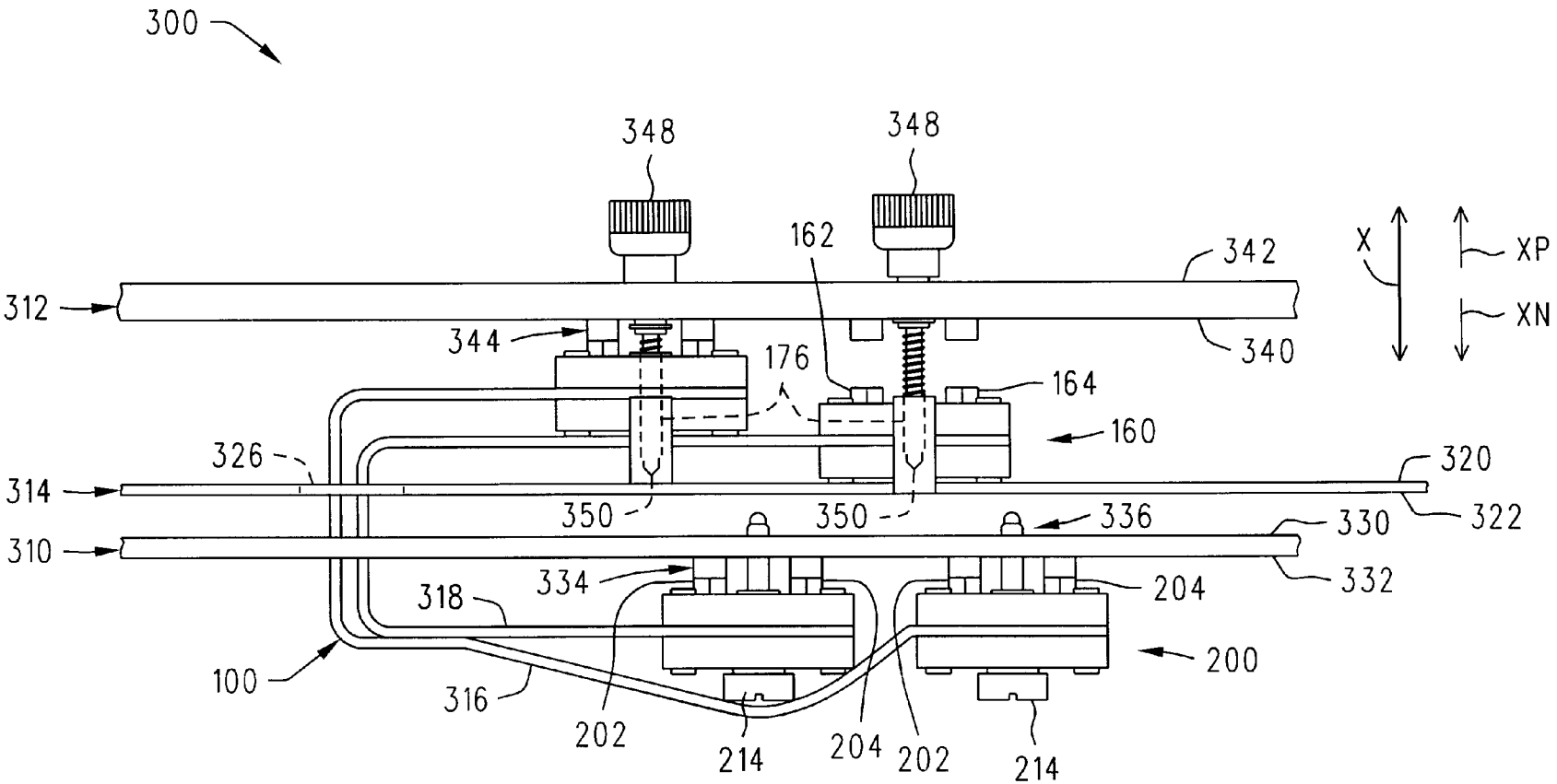
FIG. 6 is a side view of the electrical connector of FIG. 1 located within an electronic device.

Referring to FIG. 6, which is a top, partial, sectional view of the electronic device 300, the electrical connector 100 may be used to electrically connected various electronic components within the electronic device 300. The electronic device 300 may, as an example, be a computer server. The electronic device 300 is shown in FIG. 6 as having a motherboard 310 and a PCI board 312 separated by a chassis 314. The electronic device 300 is also shown as having two electrical connectors 100 connected between the motherboard 310 and the PCI board 312. For illustration purposes, the two electrical connectors 100 are referenced individually as a first electrical connector 316 and a second electrical connector 318. Reference directions within the electronic device 300 are made with respect to a x-direction X that is substantially normal to the chassis 314. Further and more precise reference directions are made with reference to a positive x-direction XP and a negative x-direction XN.

The motherboard 310 and the PCI board 312 may be conventional printed circuit boards. Both the motherboard 310 and the PCI board 312 may, at times, need to be removed from the electronic device 300 for upgrades and service. In most electronic devices, it is desirable to be able to exchange components with minimal effort and downtime. Accordingly, the electrical connectors 100 permit expedient installation and removal of the motherboard 310 and the PCI board 312, which reduces the downtime of the electronic device 300.

The portion of the chassis 314 illustrated in FIG. 6 has a first side 320 and a second side 322. The PCI board 312 is located adjacent the first side 320 and the motherboard 310 is located adjacent the second side 322. A hole 326 may be formed in the chassis 314 to allow the first electrical connector 316 and the second electrical connector 318 to pass between the first side 320 and the second side 322.

The motherboard 310 has a first side 330 and a second side 332 wherein the first side 330 faces the second side 322 of the chassis 314. A plurality of connectors 334 may be mechanically and electrically connected to the second side 332 of the motherboard 310. The connectors 334 are positioned to align with the third connectors 202 and the fourth connectors 204 on the first electrical connector 316 and the second electrical connector 318. A plurality of threaded inserts 336 may be mechanically attached to the motherboard 310 so as to be aligned with the first screws 214 and the second screws 216, FIG. 4A, on the first electrical connector 316 and the second electrical connector 318. The second connector assemblies 200 are connected to the motherboard 310 by screwing the first screws 214 and the second screws 216, FIG. 4A, into the threaded inserts 336. The second connector assemblies 200 are then forced to move in the positive x-direction XP so that the connectors 334 on the motherboard 310 mate with the third connectors 202 and fourth connectors 204 on the first electrical connector 316 and the second electrical connector 318. Because the first screws 214 and the second screws 216, FIG. 4A, are captive, removing them from the threaded inserts 336 will cause the second connector assemblies 200 to disconnect from the motherboard 310.

The PCI board 312 has a first side 340 and a second side 342, wherein the first side 340 faces the first side 320 of the chassis 314. A plurality of connectors 344 may be connected to the first side 340 of the PCI board 312. A plurality of screws 348 may pass through the PCI board 312. The screws 348 may have ends 350 that are substantially pointed and serve to align the screws 348 to the second threaded inserts 176 in the first connector assemblies 160. The screws 348 may, as examples, be captive or "jack" screws. As will be described in greater detail below, the screws 348 serve to connect the first connector assemblies 160 to the connectors 344 located on the PCI board 312.

Due to the physical layout of the PCI board 312, the connectors 344 may be relatively centrally located on the PCI board 312. Accordingly, in order to use a relatively short first electrical connector 316 and second electrical connector 318 they have to connect to the first side 340 of the PCI board 312. An operator typically can neither see nor reach a hand between the PCI board 312 and the chassis 314 to attach the first connector assemblies 160 to the PCI board 312. The electrical.connector 100 overcomes this problem by providing blind mate capabilities between the first connector assemblies 160 and the PCI board 312.

This blind mate capability may, in part, be achieved by mounting the first connector assemblies 160 of the first electrical connector 316 and the second electrical connector 318 to the first side 320 of the chassis 314 so that they are movable in the x-direction X. For example, with additional reference to FIG. 4A, pins, not shown, may extend from the first side 320 of the chassis 314 and may be received by the hole 180 and the slot 184 formed in the first connector assemblies 160. The use of a slot and a hole provides for easier mounting of the first connector assemblies 160 to the chassis 314 and allows the first connector assemblies 160 to float relative to the chassis 314.

Connecting the PCI board 312 to the first connector assemblies 160 is achieved by securing the PCI board 312 to the chassis 314 as described above. It should be noted that FIG. 6 shows the first connector assembly 160 associated with the first electrical connector 316 disconnected from the PCI board 312 and the first connector assembly 160 associated with the second electrical connector 318 connected to the PCI board 312. The PCI board 312 is positioned relative to the chassis 314 so that the connectors 344 on the PCI board 312 are in close proximity to the first connectors 162 and the second connectors 164 located on the first connector assemblies 160. The threaded portions of the screws 348 extend into the first threaded inserts 174, FIG. 1, and the second threaded inserts 176 which are facilitated by the pointed ends 350 of the screws 348. The position of the screws 348 relative to the second threaded inserts 176 is shown with respect to the first connector assembly 160 of the second electrical connector 318.

When the ends 350 of the screws 348 are in the first threaded inserts 174, FIG. 1 and the second threaded inserts 176, the screws 348 are rotated. The first connector assemblies 160 are then drawn in the positive x-direction XP toward the PCI board 312. The precise alignment of the screws 348 to the PCI board 312 causes the connectors 344 to mate with the first connectors 162 and the second connectors 164 on the first connector assemblies 160. The first connectors 162 and the second connectors 164 may have keys or the like formed therein that precisely align the keys or the like formed into the connectors 344. The keys provide for precise alignment between the first connectors 162, the second connectors 164, and the connectors 344. The connection of the first connector assembly 160 to the PCI board 312 is shown with respect to the second electrical connector 318 relative to the PCI board 312. Disconnecting the first connector assemblies 160 from the PCI board 312 is achieved by rotating the screws 348 in the opposite direction. This rotation forces the first connector assemblies 160 to move in the negative x-direction XN and away from the PCI board 312. Accordingly, the first connectors 162 and the second connectors 164 disconnect from the connectors 344.

The electrical connector 100 described herein provides many benefits over conventional connector assemblies. The blind mate capabilities allow the electrical connector 100 to be connected to connectors that are inaccessible to a user. The flexibility of the electrical connector 100 allows the electrical connector 100 to be used in an electrical connector 100 that is subject to vibration and shock. Rigid connector assemblies are more likely to fail when subjected to these conditions. In addition, the electrical connector 100 is able to be used in situations where the motherboard 310 or the PCI board 312 are movably mounted to the chassis 314. For example, in situations where an elastic shock absorbing device is used to connect the motherboard 310 or the PCI board 312 to the chassis 314. The physical characteristics of the flexible circuit 110, FIG. 2, provide for the conductors to have precise intrinsic impedance.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. An electrical connector assembly comprising:

a flexible circuit comprising a first end portion, a second end portion, a first surface, and a second surface, said flexible circuit comprising a plurality of conductors extending between said first end portion and said second end portion; and a first connector assembly attached to said circuit first end portion;

said first connector assembly comprising:

a first connector electrically connected to at least one of said plurality of conductors;

a first plate comprising at least one opening, wherein said first connector is located within said at least one opening; and a second plate located adjacent said circuit second surface and opposite said first plate, said second plate comprising a flat surface proximate said at least one opening of said first plate, said flat surface facing said at least one opening;

said flexible circuit being located between said first plate and said second plate.

2. The electrical connector assembly of claim 1 wherein said first connector assembly further comprises a first threaded portion extending through said second plate; said first threaded portion being located at a preselected location relative to said first connector.

3. The electrical connector assembly of claim 2 wherein said threaded portion is a screw.

4. The electrical connector assembly of claim 3 wherein said screw is captive within said first connector assembly.

5. The electrical connector assembly of claim 2 wherein said threaded portion is a threaded insert.

6. The electrical connector assembly of claim 1 wherein said plurality of conductors are spaced a distance of about 0.012 inches to about 0.014 inches.

7. The electrical connector assembly of claim 1 wherein said plurality of conductors are spaced a distance of about 0.0135 inches.

8. The electrical connector assembly of claim 1 wherein said plurality of conductors have widths of about 0.004 inches.

9. The electrical connector assembly of claim 1 and further comprising:

a second connector assembly attached to said circuit second end portion, said second connector assembly comprising:

a second connector electrically connected to at least one of said plurality of conductors;

a third plate at least partially encompassing said second connector and located adjacent said circuit second surface;

a fourth plate located adjacent said circuit first surface and aligned with said third plate;

said third plate and said fourth plate being mechanically coupled.

10. The electrical connector assembly of claim 1 wherein said circuit comprises a plurality of conductive layers extending between said circuit first end portion and said circuit second end portion.

11. The electrical connector assembly of claim 10 wherein said plurality of conductive layers are located between a first insulating layer and a second insulating layer, wherein said first insulating layer and said second insulating layer are less conductive than said plurality of conductive layers.

12. The electrical connector assembly of claim 10 wherein at least one of said plurality of conductive layers comprises a plurality of conductors extending between said circuit first end portion and said circuit second end portion.

13. The electrical connector assembly of claim 12 and further comprising a first insulting layer and a second insulating layer, wherein said first insulating layer is located adjacent a first side of said plurality of conductors and said second insulating layer is located adjacent a second side of said plurality of conductors.

14. The electrical connector assembly of claim 12 and further comprising a first conductive layer and a second conductive layer substantially parallel to said first conductive layer, wherein said plurality of conductive layers are located between and at least partially encompassed by said first conductive layer and said second conductive layer.

15. The electrical connector assembly of claim 14 wherein said first conductive layer has a surface and wherein said surface and said plurality of conductors are separated by a distance of about 0.00216 inches to about 0.00264 inches.

16. The electrical connector assembly of claim 14 wherein said first conductive layer has a surface and wherein said surface and said plurality of conductors are separated by a distance of about 0.0024 inches.

17. The electrical connector assembly of claim 14 wherein said first conductive layer electrically contacts said second conductive layer.

18. The electrical connector assembly of claim 14 wherein said first conductive layer and said second conductive layer are adapted to operate at substantially the same electric potential; and wherein said plurality of conductors is adapted to transmit electric signals having potentials relative to said first and said second conductive layers.

19. The electrical connector assembly of claim 14 wherein the intrinsic impedance between said plurality of conductors and said first conductive layer is preselected.

20. The electrical connector assembly of claim 14 wherein the intrinsic impedance between said plurality of conductors and said first conductive layer is approximately fifty ohms.

21. The electrical connector assembly of claim 1 and further comprising a second connector electrically connected to at least one of said plurality of conductors; wherein said first plate has a second opening; and wherein said second connector is located within said second opening.

22. The electrical connector assembly of claim 1 wherein said circuit comprises:

a first conductive layer;

a first insulating layer located adjacent said first conductive layer;

a second conductive layer having a plurality of conductors extending between said first end portion and said second end portion, said second conductive layer being located adjacent said first insulating layer and opposite said first conductive layer;

a second insulating layer located adjacent said second conductive layer and opposite said first insulating layer; and a third conductive layer located adjacent said second insulating layer and opposite said second conductive layer.

23. The electrical connector assembly of claim 1, wherein said first plate is aligned with said second plate.

24. An electrical connector assembly comprising:

a flexible circuit having a first end portion, a second end portion, and a plurality of layers extending therebetween, said circuit comprising:

a first insulating layer;

a first conductive layer located adjacent said first insulating layer;

a second insulating layer located adjacent said first conductive layer and opposite said first insulating layer;

a second conductive layer having a plurality of conductors extending between said first end portion and said second end portion, said second conductive layer located adjacent said second insulating layer;

a third insulating layer located adjacent said second conductive layer and opposite said second insulating layer;

a third conductive layer located adjacent said third insulating layer and opposite said first conductive layer; and a fourth insulating layer located adjacent said third conductive layer and opposite said third insulating layer;

a first connector assembly attached to said circuit first end portion, said first connector assembly comprising:

a first connector electrically connected to at least one of said plurality of conductors;

a first plate at least partially encompassing said first connector; and a second plate located adjacent said first plate, wherein said circuit is located between said first and said second plates.

25. An electronic device comprising:

a first component having a first connector associated therewith;

a second component having a second connector associated therewith; and an electrical connector assembly comprising:

a flexible circuit having a first end portion, a second end portion, a first surface, and a second surface, said flexible circuit having a plurality of conductors extending between said first end portion and said second end portion;

a first connector assembly attached to said circuit first end portion, said first connector assembly comprising:

a first connector electrically connected to at least one of said plurality of conductors;

a first plate having at least one opening, wherein said first connector is located within said at least one opening; and a second plate located adjacent said circuit second surface and opposite said first plate;

said first plate and said second plate being mechanically coupled;

a second connector assembly attached to said circuit second end portion, said second connector assembly comprising:

a second connector electrically connected to at least one of said plurality of conductors;

a third plate at least partially encompassing said second connector and located adjacent said circuit second surface; and a fourth plate located adjacent said circuit first surface and opposite said third plate;

said third plate and said fourth plate being mechanically coupled;

wherein said circuit first connector is electrically connected to said first component first connector; and wherein said circuit second connector is electrically connected to said second component second connector.

26. The electronic device of claim 25 and further comprising a chassis, said chassis having a first side, a second side, and a hole therebetween, said first component being attachable to said chassis first side and said second component being attachable to said chassis second side, and said electrical connector assembly passing through said hole.

27. The electronic device of claim 25 wherein said first component first connector has a first threaded portion located at a preselected location, wherein said circuit first connector assembly has a second threaded portion located at a preselected location relative to said first connector, wherein when said first threaded portion is aligned with said second threaded portion, said first component first connector is aligned with said circuit first connector.

28. The electronic device of claim 27 wherein said first threaded portion is a screw and wherein said second threaded portion is a nut.

29. The electronic device of claim 27 wherein said second threaded portion is a threaded insert.

30. The electronic device of claim 25 wherein said circuit first connector has a first alignment mechanism attached thereto, wherein said first component first connector has a second alignment mechanism attached thereto, and wherein said first alignment mechanism aligns with said second alignment mechanism to align said circuit first connector to said first component first connector.

31. The electrical connector assembly of claim 25, wherein said first plate is aligned with said second plate, and wherein said second plate comprises a solid portion aligned with said at least one opening of said first plate.

* * * * *